US005125655A

United States Patent [19]

Crooks

[11] Patent Number: 5,125,655

[45] Date of Patent: Jun. 30, 1992

[54] GOLFER'S GRIP POSITION LOCATING DEVICE

[76] Inventor: Wayne R. Crooks, 5959 McKinney NE., Albuquerque, N. Mex. 87109

[21] Appl. No.: 786,899

[22] Filed: Nov. 1, 1991

[51] Int. Cl.[5] ..... A63B 69/36; A63B 53/00

[52] U.S. Cl. ..... 273/32 H; 273/183 D; 273/162 R; 273/162 F; 273/165; 273/77 A; 273/81 B; 33/508

[58] Field of Search ..... 273/32 R, 32 H, 81 B, 273/165, 162 R, 162 F, 77 A; 33/508

[56] References Cited

U.S. PATENT DOCUMENTS

| | | | |
|---|---|---|---|
| 1,448,505 | 3/1923 | Powers | 273/32 R |
| 2,223,437 | 12/1940 | Yeager, Jr. | 273/165 |
| 2,710,190 | 6/1955 | Schimansky | 273/165 |
| 3,036,836 | 5/1962 | Mason | 273/165 |
| 3,256,023 | 6/1966 | Frazelle | 273/165 |
| 3,293,762 | 12/1966 | Solheim | 33/508 |
| 3,860,243 | 1/1975 | Prisco, Sr. | 273/165 |
| 4,468,034 | 8/1984 | Duclos | 33/508 X |
| 4,532,712 | 8/1985 | Vistain | 33/508 X |

*Primary Examiner*—George J. Marlo

[57] ABSTRACT

A deivce used to mark a reference mark on the grip area of a golf club, to establish a hand position which is correct in relation to the angular position of the head of the club. A head plate is attached to a head plate magnet which secures it to the head of the iron. An alignment transfer string is attached to the head plate, and pulled taught up the side of the shaft, to establish the correct (angular) relationship of the gripping area, the face of the iron and the shaft. A marking template attached to the upper end of the alignment transfer, which is an elongated strip which will be oriented parallel to the shaft when the alignment transfer is pulled taught by pulling on the upper end of the marking template, has a longitudinal slot for making a permanent reference mark on the grip area of the club.

9 Claims, 1 Drawing Sheet

GOLFER'S GRIP POSITION LOCATING DEVICE

BACKGROUND OF THE INVENTION

The present invention concerns devices for assisting a golfer to obtain the correct hand position upon the grip area of a golf club, and in particular such devices for establishing a hand position that is correct in terms of angular orientation of the hand gripping position, in relation to the face of the club head.

It is well known among golfers that correct hand positioning on the grip of the club is critical to achieving a satisfactory game. One important aspect of correct hand positioning is the angular orientation of the golfer's hands in relation to the head of the golf club. Unless the golfer can reliably reproduce the correct orientation for the hand positioning on the grip area of the club, it is likely that the ball will be struck with a slicing motion, which will prevent the ball from following the desired trajectory.

There is therefore a need for a simple device which allows the golfer to easily establish a reference mark on the hand grip portion of the golf club, which reference mark is fixed in angular orientation in relation to the head of the club, and particularly the face of club which is used to strike the golf ball. There is also a need for such a device which will automatically transfer the necessary angular alignment information from the head of the club to the grip portion of the club, and no such device is known to applicant.

SUMMARY OF THE INVENTION

The invention is a simple device used to mark a permanent reference mark on the grip area of a golf club, to establish a hand position which is correct in relation to the head of the club. A head plate is attached to a head plate magnet which secures it to the head of the iron. An alignment transfer, a string in the preferred embodiment, is attached to the head plate, and pulled taught up the side of the shaft, to establish the correct (angular) relationship of the gripping area, the face of the iron and the shaft. A marking template attached to the upper end of the alignment transfer, which is an elongated strip which will be oriented parallel to the shaft when the alignment transfer is pulled taught by pulling on the upper end of the marking template, has a longitudinal slot for making a permanent reference mark on the grip area of the club. The general form of the invention does not require a particular form for the marking template, however. The device is secured in position against the side of the shaft by a string extending from the upper end of the marking template to a cap which fits over the upper end of the shaft grip portion.

The object of the invention is to provide a simple, inexpensive, easily manufactured and easily used device, which allows a golfer to very accurately establish correct angular orientation of his or her hand grip position, in relation to the angular orientation of the club face, by automatically transmitting the needed alignment information along the club shaft to the hand grip area, and allowing the user to establish a suitable reference mark, using said information, on the hand grip of the club.

DESCRIPTION OF THE PREFERRED EMBODIMENT

Figure 1:
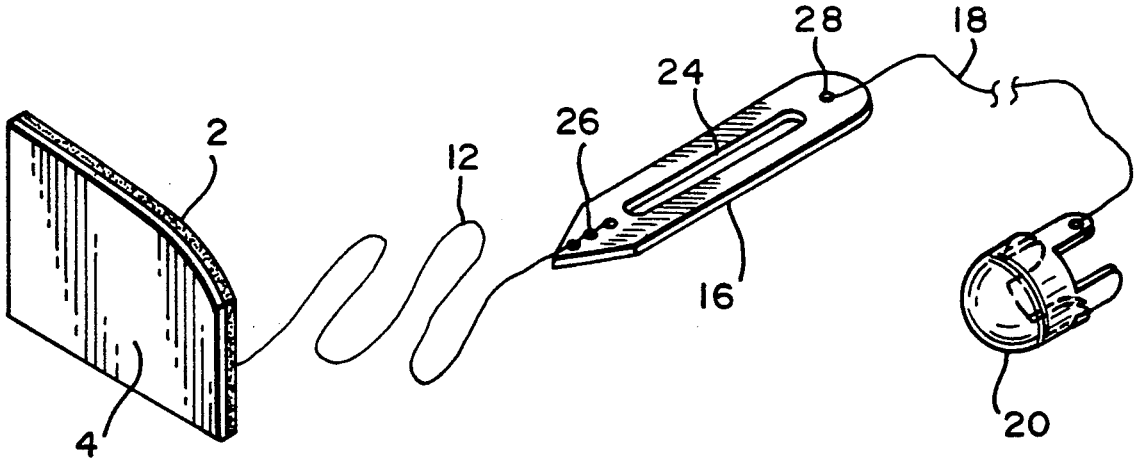
FIG. 1 is a perspective view of the components of the preferred embodiment.

Referring now to the drawings, the components of the device, shown separately in FIG. 1, include a head plate magnet 2, and a head plate 4, each being a plate having the same general shape and size as that of the face 6 of the golf club head 8 of the golf club 10 with which the device is to be used, with head plate 4 being laminated to head plate magnet 2 by means of a suitable adhesive, in order to provide structural integrity; an alignment transfer means 12, which is a string in the preferred embodiment, attached to the side of the head plate 4 which is adjacent to the shaft 14 when head plate magnet 2 and head plate 4 are attached to face 6 in such manner as to essentially cover face 6; a marking template 16, attached to the opposite end of alignment transfer means 12, further discussed below; and a securing means also attached to marking template 16, for securing marking template 16 in a configuration parallel and adjacent to shaft 14. In the preferred embodiment the securing means comprises a string 18, attached to the end of marking template 16 opposite the end to which alignment transfer means 12 is attached, and a cap 20, attached to the end of string 18 opposite to the end attached to marking template 16, with cap 20 being sized to snugly fit over the upper end of the grip portion 22 of golf club 10. The lengths of alignment transfer means 12, marking template 16, and string 18 are such that marking template 16 is located in grip portion 22 of golf club 10, and cap 20 covers the upper end of grip portion 22, when alignment transfer means 12, marking template 16, and string 18 are stretched at least essentially taught along shaft 14, as in FIG. 2. In order to accommodate clubs having varying lengths of shaft 14, one can use elastic material for alignment transfer means 12 and/or string 18, with the unstretched lengths of the alignment transfer means 12 and string 18 being such that some stretching of these components is necessary to allow cap 20 to reach the end of shaft 14. In this way the device will be held in a taut configuration along the side of shaft 14 when cap 20 is placed upon the end of shaft 14, so that the user need not hold the device in position while making the reference mark on the grip portion 22 of shaft 14 as described below.

The marking template 16 is a metal plate, long in relation to its width, having a longitudinal slot 24 extending the major portion of the length thereof, through which the user may place a reference mark upon grip portion 22 of golf club 10, by using a pencil, pen, pointed scribe or other convenient marking device. The marking template 16 has holes 26 and 28 near the lower and upper ends thereof, respectively, with which the alignment transfer means 12 and string 18 may be secured to the ends of marking template 16.

Figure 2:
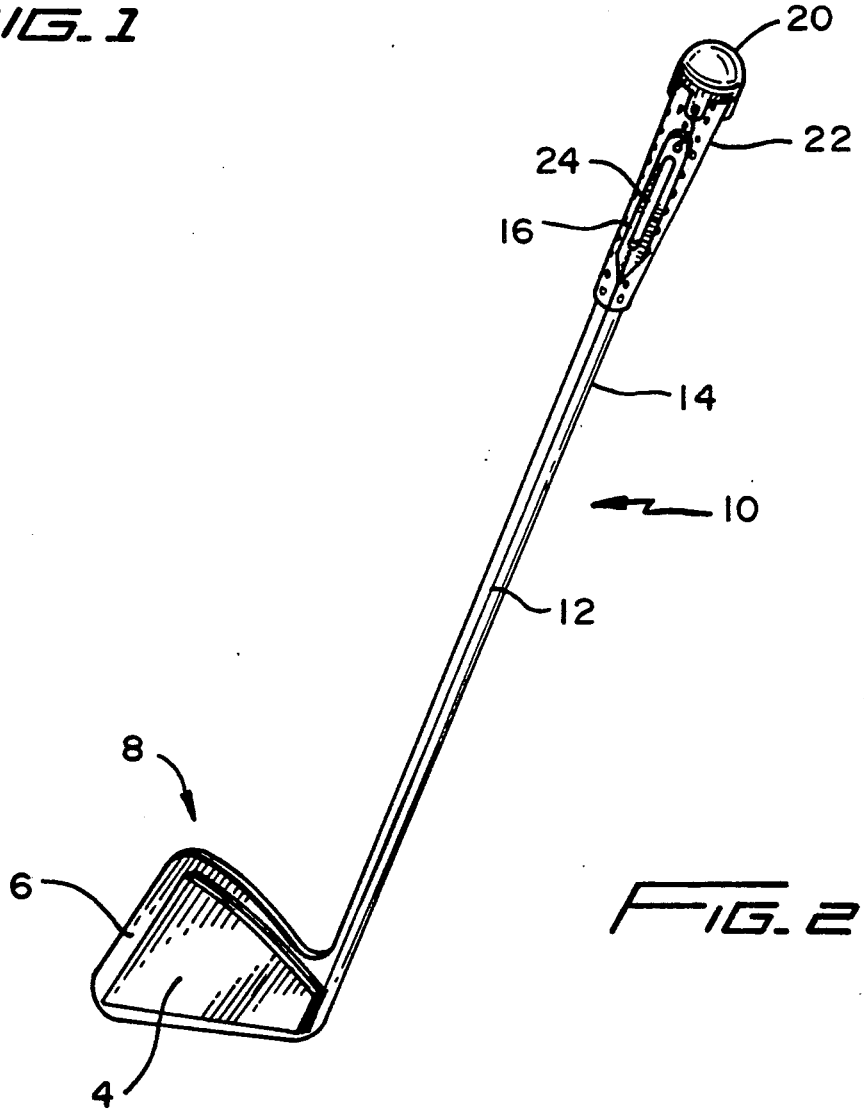
FIG. 2 is a side elevational view of the preferred embodiment device, in place for making a reference mark on the grip portion of a golf club.

In order to use the device, one simply secures the head plate magnet 2 and head plate 4 to face 6 of club head 8, in the position essentially covering face 6, as shown in FIG. 2, and stretches the remaining portion of the device, i.e. alignment transfer means 12, marking template 16, and string 18, along shaft 14, securing cap 20 to the upper end of shaft 14, as also indicated in FIG. 2, and then makes a reference mark upon grip portion 22, by placing some marking device or scribe through slot 24 in marking template 16.

In this manner, as is obvious from FIG. 2, one can easily make a mark on grip portion 22 of shaft 14 which corresponds exactly in angular orientation, to the angular orientation of face 6 of club head 8. Thus the golfer can easily and quite accurately orient the position of this hands in the desired angular orientation with respect to the direction of face 6, and thereby, with sufficient practice, reliably and consistently avoid slicing problems in striking the ball.

Those familiar with the art will appreciate that the invention may be employed in configurations other than the specific forms disclosed herein, without departing from the essential substance thereof. For example, and not by way of limitation, some such possible changes are as follows:

Other means could be used to attach the head plate 4 to face 6, rather than head plate magnet 2, such as, for example, a simple clamp device, or elastic bands on either side of head plate 4. It will also be seen by those familiar with the art, that head plate magnet 2 and head plate 4 together simply constitute one possible anchoring means for attaching the lower end of alignment transfer means 12 to face 6 of club head 8, and that other anchoring means could instead by used. For example, a small pin could be soldered to face 6 on the side thereof adjacent to shaft 14.

Similarly, although an ordinary string is used for alignment transfer means 12 in the preferred embodiment, a wire or thin tubing or chain could be used instead.

Although head plate 4, marking template 16 and cap 20 are each made of metal in the preferred embodiment, each of these parts could of course instead be made of a suitable plastic, or of wood, or of another suitable material. Head plate magnet 2 must of course be made of a magnetic material, but it is not limited to a particular magnet material.

These and other changes in details of construction could obviously be made, without departing from the essential substance of the invention.

The scope of the invention is defined by the following claims, including also all subject matter encompassed by the doctrine of equivalents as applicable to the claims.

I claim:

1. A device for use with golf clubs having club heads with differently inclined faces for striking a golf ball, each club having a shaft with a lower end and an upper end, said shaft having a longitudinal axis and being connected at said lower end of said shaft to one side of said club head adjacent to said face, and said golf club having a hand grip portion of said shaft adjacent to said upper end of said shaft; said device being a device for allowing a user of said golf club to make a reference mark on said grip portion corresponding to the angular orientation of said face with respect to said longitudinal axis of said shaft, comprising:

(a) alignment transfer means, having a lower end and an upper end, for transferring alignment information as to the angular orientation of said face with respect to said longitudinal axis, from said face to said hand grip portion of said shaft of said golf club;

(b) anchoring means, connected to said lower end of said alignment transfer means, for connecting said lower end of said alignment transfer means to said club head adjacent said face;

(c) a template having upper and lower ends, said template lower end being connected to said upper end of said alignment transfer means, for allowing a user of said device to make differently angled marks upon the hand grip portions of said shafts, each of said marks being differently angled for clubs with differently angled faces to correspond to the angular position of said face with respect to said longitudinal axis of said shaft; and (e) securing means, connected to said upper end of said template for connection to said shaft, for securing said template in a configuration parallel and adjacent to said shaft.

2. The device of claim 1, wherein said alignment transfer means comprises a string, having a lower end and an upper end, connected at said lower end to said anchoring means, and connected at said upper end to said template.

3. The device of claim 2, wherein said securing means comprises an upper string, having a lower end and an upper end, connected at said lower end of said upper string to said template, and a cap, connected at said upper end of said upper string, said cap being sized to fit over said upper end of said shaft in a snug fit engagement, and wherein the combined lengths of said string, said template and said upper string are such that said cap may be placed upon said upper end of said shaft when said string, said template and said upper string are pulled at least substantially taught along and adjacent to said shaft.

4. The device of claim 3, wherein said string and said upper string are composed of elastic material, and wherein said string, said template and said upper string have a combined length, when said string and said upper string are unstretched, which combined length is somewhat less than the total length of said shaft, and wherein said string and said upper string have a elastic limits allowing the total length of said string, said template and said upper string to be stretched to a total length equal to the length of said shaft.

5. The device of any of claims 1 through 4, wherein said template comprises a rectangular plate, having a longitudinal axis, and having a length which is substantially greater than the width of said plate, and having a slot cut through said plate and extending along the major portion of said longitudinal axis of said plate.

6. The device of claim 5, wherein said template is made of metal.

7. The device of any one of claims 1 through 4, wherein said anchoring means comprises a head plate, which is a plate having a shape at least substantially conforming to the shape of said face of said face of said club head, and a head plate magnet laminated to said head plate, said head plate magnet being a magnet in plate form, having a shape at least substantially conforming to said shape of said head plate.

8. The device of claim 7, wherein said head plate is made of metal.

9. The device of claim 3, wherein said cap is made of metal.

* * * * *